US007368087B2

(12) United States Patent
Merino Sanchez et al.

(10) Patent No.: US 7,368,087 B2
(45) Date of Patent: May 6, 2008

(54) GAS RE-USING SYSTEM FOR CARBON FIBER MANUFACTURING PROCESSES

(75) Inventors: César Merino Sanchez, Burgos (ES); Andres Melgar Bachiller, Valladolid (ES)

(73) Assignee: Grupo Antolin-Ingenieria, S.A., Burgos (ES)

( * ) Notice: Subject to any disclaimer, the term of this patent is extended or adjusted under 35 U.S.C. 154(b) by 473 days.

(21) Appl. No.: 11/142,898

(22) Filed: Jun. 1, 2005

(65) Prior Publication Data

US 2006/0021304 A1 Feb. 2, 2006

(30) Foreign Application Priority Data

Jun. 1, 2004 (EP) ..... 04381015

(51) Int. Cl.

| | |
|---|---|
| ***B32B 5/02*** | (2006.01) |
| ***B01J 10/00*** | (2006.01) |
| ***B01J 19/00*** | (2006.01) |
| ***B01J 8/00*** | (2006.01) |
| ***D01C 5/00*** | (2006.01) |

(52) U.S. Cl. ..... 422/105; 422/112; 422/113; 422/129; 422/188; 422/150; 422/158; 422/198; 422/234; 423/447.3

(58) Field of Classification Search ..... 422/105, 422/112, 113, 150, 158, 129, 188, 198, 234; 423/447.3

See application file for complete search history.

(56) References Cited

U.S. PATENT DOCUMENTS

| | | | | |
|---|---|---|---|---|
| 5,024,818 | A * | 6/1991 | Tibbetts et al. | 422/158 |
| 5,165,909 | A | 11/1992 | Tennent et al. | |
| 2004/0223901 | A1 * | 11/2004 | Smalley et al. | 423/447.3 |

OTHER PUBLICATIONS

*Journal of Crystal Growth 32* (1976) "Filamentous Growth of Carbon Through Benzene Decomposition", by A. Oberlin and M. Endo, pp. 335-349.

* cited by examiner

*Primary Examiner*—Glenn Caldarola
*Assistant Examiner*—Lessanework T Seifu
(74) *Attorney, Agent, or Firm*—Collard & Roe, P.C.

(57) ABSTRACT

A gas re-use system for carbon fiber manufacturing processes based on hydrocarbon thermal decomposition. The system permits re-use of the output gas from the carbon fiber manufacturing process, a process based on the use of an industrial gas as the main raw material. The system can comprise a feedback pipeline provided with force and filtering means to raise the pressure from the reaction furnace output manifold to its input. There are also return and bleed lines operated separately to assure suitable pressure ranges at the same time both in the reaction furnace input area and extraction area.

10 Claims, 1 Drawing Sheet

GAS RE-USING SYSTEM FOR CARBON FIBER MANUFACTURING PROCESSES

CROSS REFERENCE TO RELATED APPLICATIONS

This application hereby claims priority from EP 04381015.9 filed on 1 Jun. 2004, the disclosure of which is hereby incorporated by reference.

BACKGROUND

The present invention relates to a gas re-use system for carbon fiber manufacturing processes based on hydrocarbon thermal decomposition.

The system can relate to or provide for the re-use of gas stemming from the carbon fiber manufacturing process, a process based on the use of an industrial gas as the main raw material.

There can be a feedback pipeline having a force and filtering means to raise the pressure from the reaction furnace output manifold to the input. There are, in turn, return and bleed lines operated independently that assure suitable pressure ranges at the same time both in the reaction furnace feed area and in the extraction area.

This system can have a control means that makes use of mass controllers to adjust the supply of raw materials and the supply of residual gas to keep the gases entering the reaction furnace constant in suitable proportions.

There can be a check made such that the residual gas is practically the same as that of the gas used as raw material.

Carbon nanofibers are filaments of submicron vapour grown carbon fiber (usually known as s-VGCF) of highly graphitic structure which are located between carbon nanotubes and commercial carbon fibers, although the boundary between carbon nanofibers and multilayer nanotubes is not clearly defined.

Carbon nanofibers have a diameter of 30 nm-500 nm and a length of over 1 m.

There is scientific literature available describing and modelizing both the physicochemical characteristics of nanofiber and the generation process at microscopic level from the carbon source used in its production.

These models have been created in most cases on the basis of laboratory experiments making use of controlled atmospheres combined with electron scanning or transmission microscopes Carbon nanofibers are produced on the basis of catalysis by hydrocarbon decomposition over metal catalytic particles from compounds with metallic atoms, forming nanometric fibrillar structures with a highly graphitic structure.

There are studies, such as those of Oberlin [Oberlin A. et al., Journal of Crystal Growth 32, 335 (1976)], in which the growth of carbon filaments over metallic catalytic particles is analysed by electron transmission microscope.

On the basis of these studies, Oberlin proposed a growth model based on the diffusion of carbon around the surface of the catalytic particles until the surface of the particles is poisoned by an excess of carbon.

He also explained that deposition by carbon thermal decomposition is responsible for the thickening of the filaments and that this process takes place together with the growth process and is therefore very hard to prevent.

For this reason, once the growth period has finished, for instance by poisoning of the catalytic particle, the thickening of the filament is maintained if the pyrolysis conditions continue to exist.

Afterwards, other growth models were put forward that have been considered in the light of experimental data and starting from different simplifying hypotheses that give rise to results to match up to a greater or lesser extent with the observations obtained in the laboratory.

Metal catalytic particles are formed of transition metals with an atomic number between 21 and 30 (Sc, Ti, V, Cr, Mn, Fe, Co, Ni, Cu, Zn), between 39 and 48 (Y, Zr, Nb, Mo, Tc, Ru, Rh, Pd, Ag, Cd), or between 73 and 78 (Ta, W, Re, Os, Ir, Pt). It is also possible to use Al, Sn, Ce and Sb, while those of Fe, Co and Ni are especially suitable.

Different chemical compounds may be used as a source of catalytic metal particles for the continuous production of carbon nanofibers, such as inorganic and organometallic compounds.

There is a significant jump with regard to production method and means from laboratory results to the production of industrial quantities of nanofiber in acceptable conditions from the engineering and economic cost point of view.

On an industrial scale, the ways of preparing metal catalytic particles for feeding into the reaction furnace may be classified in two groups: with substrate and without substrate.

In the former case, when the metal particles are added as substrate, fibers are obtained whose application calls for them to be aligned, as is the case of the use of electron emission sources for microelectronic applications.

In the latter case, also known as floating catalyst, the reaction occurs in a certain volume without the metal particle being in contact with any surface, with the advantage that the nanofibers produced do not have to be separated from the substrate afterwards.

It is very highly improbable that the carbon nanofibers will grow directly from the initial carbon source. It is believed that the filaments appear from side products generated from the thermal decomposition of the initial carbon source.

Some authors state that for light hydrocarbons below C16 any of them may be used without the quality of the nanofiber obtained being dependant on the hydrocarbon selected.

Carbon nanofibers are used for making charged polymers giving rise to materials with enhanced qualities, such as resistance to stress, modulus of elasticity, electrical conductivity and thermal conductivity. Other applications are, for instance, their use in tires in partial replacement of carbon black, or in lithium ion batteries, as carbon nanofibers are readily collated with lithium ions.

When considering the nanofiber growth models, it has been considered that deposition due to carbon thermal decomposition is responsible for the thickening of the filaments produced together with the growth process and that this thickening is maintained if pyrolysis conditions continue to exist. Consequently, in an industrial furnace, thickening continues if the nanofiber is kept in the reactor.

The dwell time of the fibers in the reactor is very important as the longer the dwell time, the larger the diameter of the fibers produced. The dwell time depends on multiple variables connected with the reaction, including the temperature of the furnace, the sizes of the tubes, the pressure gradient, and others. It is advisable to keep the whole system below atmospheric pressure to prevent leaks; however, for their operation the control system and the mass controllers need to work above atmospheric pressure.

The manufacture of nanofibers of this type in industrial processes has been addressed by means of techniques such as that described in the U.S. Pat. No. 5,165,909 incorporated herein by reference, in which use is made of a vertical reactor operating at around 1100° C.

The fiber obtained in this furnace has a diameter between 3.5 and 70 nanometres and a length between 5 and 100 times the diameter.

Regarding the inner structure of the fiber obtained by this procedure, the fiber is made up of concentric layers of ordered atoms and a central area that is either hollow or contains disordered atoms.

The reaction furnace used in this patent is supplied at the top mainly with CO used as the gas with carbon content, a catalyst compound with iron content, and all this in the presence of hydrogen as the diluent gas.

A ceramic filter is situated after the reaction furnace for separating the residual gas and the fiber obtained.

This patent uses a gas residual gas treatment line with a feedback line that comprises a compressor and a small bleed valve, a chemical potassium hydroxide filter to remove the carbon dioxide, and a supply input for enriching the residual gas with carbon monoxide.

The resultant flow divides into two branches: three quarters go to a heat exchanger and from there to the bottom of the furnace to prime the ceramic filter, and the remaining quarter goes to reaction furnace input.

In contrast, the invention can relate to a system for the recirculation of residual gas to the supply, which enables the residual gas from the process to be recirculated and monitors both the feed gases and the pressures required at the reaction furnace input and output.

The special configuration of the system based on the installation of a feedback line leads to a considerable reduction in contamination due to re-use of residual gas.

The result is a lowering of the cost of production through use of less raw material due to the re-use of process output gas.

SUMMARY

There can be a gas re-use system for carbon fiber manufacturing processes.

Carbon fiber is manufactured by means of a vertical or horizontal floating catalyst reaction furnace which operates at between 800° C. and 1500° C., the temperature needed to achieve the pyrolysis of a hydrocarbon. The importance of using a recirculation circuit lies in the richness of the residual gas, so the invention is applicable both to vertical and horizontal reaction furnaces.

Growth of the carbon fiber occurs starting from a compound with metal catalytic particles and a gaseous hydrocarbon in a diluent gas.

The reaction furnace has a supply of raw material: a hydrocarbon, a diluent gas, a catalyst precursor compound and also a catalyst gas from the gas re-use system which is the object of this invention.

Of the raw materials used, the catalyst precursor compound is the one that to a very large extent determines the rate of production, as the fiber grows from the metal particles that it contains. The rest of the gases, the feed hydrocarbon and the diluent gas must be in the right proportions along with the catalyst and may be partly replaced by residual gas by means of feedback, as occurs with the system covered by one embodiment of this invention.

The residual gas is primarily a mixture of gaseous hydrocarbon and the diluent gas which have not reacted.

The residual gas system comprises basically of a pipeline that communicates the residual gas output manifold with the reaction furnace input.

This pipeline has to overcome the difference in pressures between the reaction furnace input and output. The pressure is raised by means of a compressor which has a filter upstream of the input to prevent its mechanical components from being damaged. Downstream of the compressor, there can be an optional buffer tank, which provides for better regulation in the pressure levels.

Downstream of this buffer tank the system also comprises a line that runs back to the manifold.

This return line has a bleed pipe to prevent the presence of overpressures and a solenoid valve controlled according to a signal obtained at a pressure gauge attached to the manifold.

The solenoid valve opens when the pressure in the manifold is too low. In this way, the pressure at the output of the reaction furnace is regulated, so that reaction conditions are maintained inside the reaction furnace.

Before reaching the reactor input area, the residual gas re-use line has a diluent gas content meter. The reading of this meter makes it possible to determine the proportions of the input flows both of hydrocarbon and of pure diluent and of fed back residual gas. This regulation is achieved by making use of mass controllers for each supply line.

Gas re-use drastically reduces cost requirements, mainly of diluent gas and secondly of hydrocarbon.

By means of the residual gas feedback flows and the returns with which it is provided, this system successfully keeps the pressure stabilized both at the input and at the output with very narrow variation ranges.

The presence of a diluent concentration meter at the end of the residual gas feedback line operating together with the mass controllers both in the supply of the diluent and hydrocarbon gases and in the residual gas feedback gives rise to a control of the latter's enrichment.

With this design, chemical treatment is not needed for the use of reused gas and the overall fiber production process is successfully kept operational.

In the control of overpressure by means of a bleed line, since there are return bypasses that help to reduce the pressure at the compressor, the output via this bleed line is minimal.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
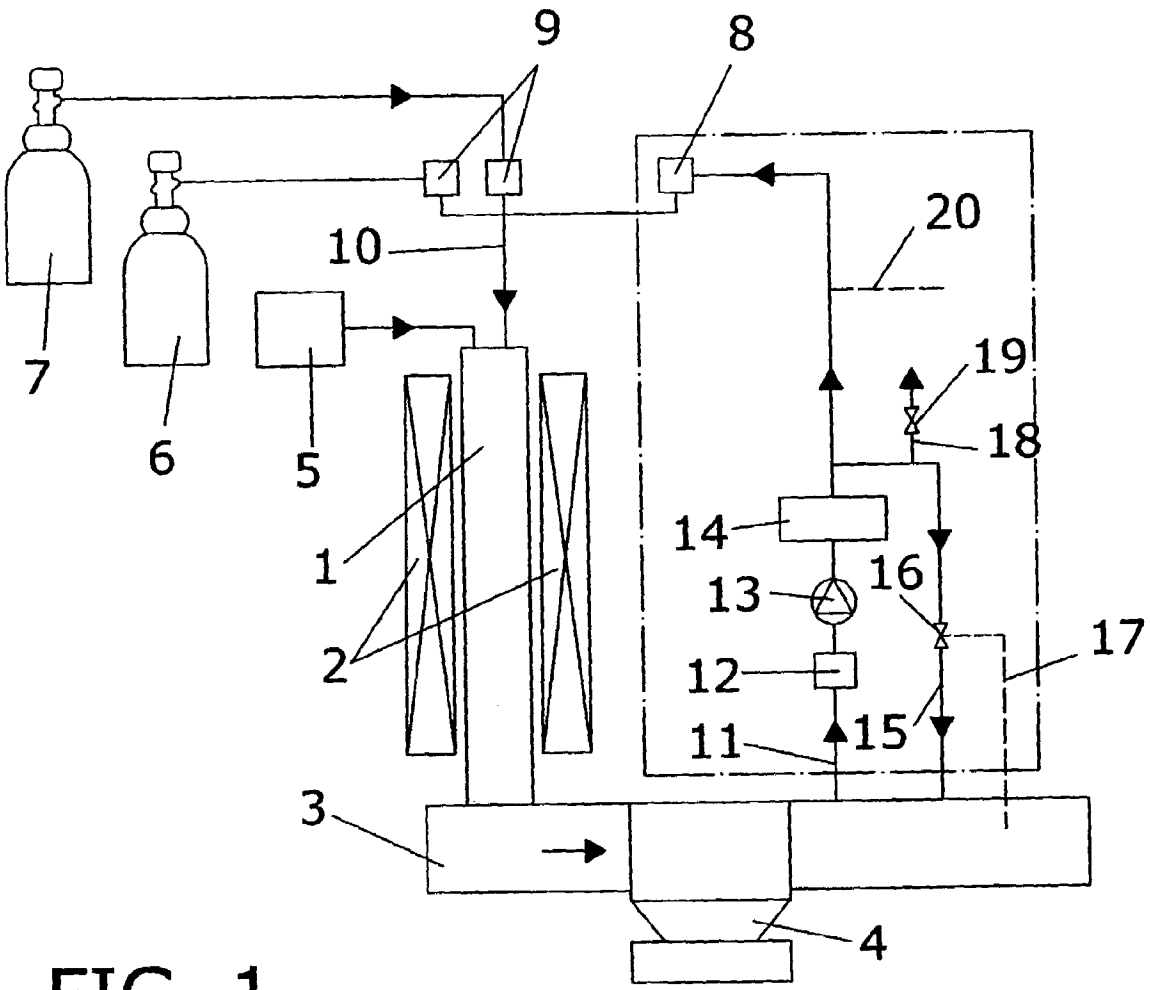
FIG. 1 shows a diagram of a specimen embodiment of the invention composed of the gas re-use system which makes use of a single reaction furnace.

Turning in detail to the drawings FIG. 1 is a diagram of an embodiment comprising a gas re-use system applied to a simple furnace, for descriptive purposes, which uses a furnace which can be in the form of a single, vertical round cross sectional reaction pipe 1 which can be made from a ceramic material.

The ceramic material, can be mullite for instance, and is resistant to corrosion and to the presence of sulphur byproducts. It is possible, however, to use alloyed metals, nickel-based for instance, that offer a suitable performance.

Although this design can act as a recirculation system, the type of gas used in the system determines the mixture of residual gas fed back. Both the supply gases and the residual gas predetermine the material to be used in furnace 1. This dependency is considered important, because including a feedback establishes the interdependence of the variables of the whole system, in particular the material of furnace 1 in respect of the gas used.

The furnace or reaction pipe 1 is heated by electrical resistances 2 to temperature of 800° C. to 1500° C.

Hydrocarbon thermal decomposition then occurs in furnace 1 in the presence of metal catalysts and a diluent.

As a result of this reaction, in the tests performed in the system covered using natural gas or acetylene as the hydrocarbon, hydrogen as the diluent, and ferrocene as the compound with metallic particles, there are produced sub-micron carbon fiber nanofibers with a diameter of 30-500 nanometres and a length of over 1 micrometre.

These fibers grow in the vapor phase during the reaction starting from a metallic catalytic particle, forming graphitic structures of carbon atoms around this metallic particle and giving rise to a sub-micron carbon fiber.

The growth of nanofibers occurs in ceramic furnace pipe 1 as long as the temperature conditions favoring the reaction are maintained.

At the lower end of furnace pipe 1 there is a manifold 3 which conveys both the residual gas and the fiber produced to the fiber collection device 4. This manifold 3 may be configured as a sealed ring with a recirculating flow without the design being affected.

The compound with metallic catalytic particles 5 in vapor phase and a carbon-containing gas 6 are fed into the upper end of the ceramic reaction pipe 1 along with a diluent 7.

The compound with metallic catalytic particles 5 may be any one incorporating a transition metal, and particularly iron, cobalt or nickel.

The carbon-containing gas 6 is industrial gas, in particular in this embodiment untreated gas is used. The main element of natural gas is methane, although it also contains small amounts of carbon monoxide, sulphur compounds as an odorizing agent, ethane and small quantities of other hydrocarbons.

The diluent gas 7 used in this specimen embodiment is hydrogen.

The absence of natural gas treatment calls for the use of a ceramic reaction tube to prevent corrosion.

Carbon nanofibers carried in the process residual gas, primarily methane and hydrogen, are obtained at the output of furnace 1.

FIG. 1 shows a residual gas re-use system which is highlighted by using a rectangle containing it represented by a broken and dotted line.

The residual mixture is conducted by the manifold 3, which has a means for collecting the fiber 4 without detaining the gases. The residual gas is conveyed from the manifold 3 back to the furnace feed area 1 by a recirculation pipe 11 which is fitted with a physical particle filter 12 and a compressor 13 which raises the pressure of the mixture. This compressor 13 may be a centrifugal compressor for instance.

The physical filter 12 prevents the particles from entering the compressor and damaging, or even putting it out of action. If using a centrifugal compressor 13 the intake of particles would damage the vanes.

Without chemical treatment, the mixture is re-used as a component element of the compounds that are supplying the furnace 1 continuously.

Downstream of compressor 13 a buffer tank 14 may be included to reduce the pressure variation ranges and improve its regulation.

Before the arrival of the gas flowing along the recirculation pipe 11 to the dispensing system at the top of furnace 1, an analysis is performed with a meter or sensor 20 to determine the hydrogen content in the mixture so as to regulate what amount of natural gas 6 or hydrogen gas 7 needs to be added for the proportions of both gases to be kept constant at the reactor input.

The analysis with the hydrogen content meter 20 is done continuously and the information is sent to the control device which is responsible for establishing the amounts of gases that are going to take part in the reaction by means of mass controllers 8,9.

The quantities to be added are regulated by means of mass controllers 8,9, one for the gas recirculated by feedback pipe 11, another for the natural gas 6 and another for the hydrogen gas 7. These three gases flow together into a single pipe 10 at the input to furnace 1.

In recirculation pipe 11, there is a branch linking up with a compensation pipe 15 which runs back into manifold 3. Furnace output 1 and manifold 3 work at a constant pressure below atmospheric, from −1 to 200 mbar.

To keep the pressure constant in the system and to offset the drops in pressure due to different reaction yields, gas is fed into feedback pipe 11 high pressure area, achieved by compressor 13, by way of compensation pipe 15.

The amount of gas to be fed into manifold 3 is controlled by a solenoid valve 16, which picks up the pressure signal from manifold 3 by means of a pressure sensor 17.

To keep the supply line pressure constant to recirculation gas mass controller 8, there is a bypass, which is a bleed pipe 18, in compensation pipe 15. Bleed pipe 18 has a valve 19 to permit gas releases above a certain pressure. In this way, a pressure ceiling is established.

Downstream of compressor 13 and up to the upper intake in the ceramic furnace 1, the gas is pressurized between 100 mbar and 1 bar, to supply the dispensing devices such as mass controllers 8, 9 which are installed in the pipes in this section before reaching the common feed pipe 10.

The gas circulating along feedback pipe 11 goes as far as the mass controller 8 which controls the amount of residual gas that will go on to form part of the new mixture. The new mixture is obtained after the dispensing by mass controllers 8, 9 of the natural gas 6 and hydrogen 7 together with residual gas, and they all pass along common pipe 10 to join up at the top of ceramic furnace 1 with the metal catalytic compound 5.

In this way, the residual process gas is successfully re-used and the pressures are kept constant.

Accordingly, while at least one embodiment of the present invention have been shown and described, it is obvious that many changes and modifications may be made thereunto without departing from the spirit and scope of the invention.

What is claimed is:

1. A gas re-use system for a carbon fiber manufacturing process comprising:

a) a furnace;

b) a main pipe;

c) a gas collection manifold;

d) at least one mass controller wherein said main pipe runs from said gas collection manifold to said at least one mass controller, wherein said at least one mass controller is positioned to lead into an intake of said furnace;

e) a compressor in communication with said main pipe;

f) a physical particle filter disposed upstream of said compressor;

g) a pressure regulating means in communication with said main pipe, and including a bleed pipe having a solenoid valve set to limit a maximum pressure, and a bypass line which runs back to said manifold, and at least one additional solenoid valve;

h) at least one pressure sensor for reading a pressure in said manifold wherein said at least one additional solenoid valve opens when said at least one pressure sensor indicates a pressure below a benchmark level to prevent excessive pressure differences between an input pressure in said furnace and an output pressure in said furnace; and i) at least one diluent gas content meter coupled to said main pipe, which is used to assure a particular proportion between a set of supply gasses and a residual gas including a hydrocarbon and a diluent gas to be fed in to said furnace, wherein said proportion is determined by said at least one mass controller.

2. The gas re-use system for carbon fiber manufacturing processes as in claim 1, wherein the hydrocarbon used in said set of supply gasses is natural gas.

3. The gas re-use system for carbon fiber manufacturing processes as in claim 1, wherein the hydrocarbon used in said set of supply gasses is acetylene.

4. The gas re-use system for carbon fiber manufacturing processes as in claim 1, wherein said diluent gas used in said set of supply gasses is hydrogen.

5. The gas re-use system for carbon fiber manufacturing processes as in claim 1, wherein a compound with metallic catalytic particles is introduced into the system wherein said compound comprises ferrocene.

6. The gas re-use system for carbon fiber manufacturing processes as in claim 1, wherein at the output of said compressor, said pressure regulating means also comprises a buffer tank.

7. The gas re-use system for carbon fiber manufacturing processes as in claim 1, further comprising a fiber collection device disposed in said manifold.

8. The gas re-use system for carbon fiber manufacturing processes as in claim 1, wherein said compressor is a centrifugal compressor.

9. The gas re-use system for carbon fiber manufacturing processes as in claim 1, wherein said furnace pipe is made from mullite.

10. The gas re-use system for carbon fiber manufacturing processes as in claim 1, wherein said furnace pipe is a nickel-based metal alloy.

* * * * *